US007069853B1

(12) United States Patent
Solomon, Jr. et al.

(10) Patent No.: US 7,069,853 B1
(45) Date of Patent: Jul. 4, 2006

(54) ERGONOMICALLY IMPROVED MULTIPLE SURFACE STAMP

(76) Inventors: John J. Solomon, Jr., 7 Whitney Dr., Lincoln, RI (US) 02806; John C McCarthy, 5 Middlebrook Ln, Lincoln, RI (US) 02865

( * ) Notice: Subject to any disclaimer, the term of this patent is extended or adjusted under 35 U.S.C. 154(b) by 0 days.

(21) Appl. No.: 10/897,883

(22) Filed: Jul. 24, 2004

(51) Int. Cl.
*B41K 1/04* (2006.01)

(52) U.S. Cl. ..... 101/405; 101/368

(58) Field of Classification Search ..... 101/405, 101/327
See application file for complete search history.

(56) References Cited

U.S. PATENT DOCUMENTS 2,176,160 A * 10/1939 Uhr, Jr. ..... 101/381
2,195,994 A * 4/1940 Morse ..... 101/405
2,899,895 A * 8/1959 Tannery ..... 101/381
3,494,040 A * 2/1970 Goodwin ..... 101/375
4,187,772 A * 2/1980 Hollenbeck ..... 101/379
4,452,142 A * 6/1984 Eckels ..... 101/368
4,924,773 A * 5/1990 Gwilliam ..... 101/327
5,048,414 A * 9/1991 Hoshino ..... 101/93.18
5,228,387 A * 7/1993 Siculan ..... 101/211
5,829,352 A * 11/1998 Taira et al. ..... 101/327
6,324,977 B1 * 12/2001 Hadden ..... 101/405
6,892,637 B1 * 5/2005 Petersen ..... 101/333

* cited by examiner

*Primary Examiner*—Daniel J. Colilia
(74) *Attorney, Agent, or Firm*—Robert J Doherty

(57) ABSTRACT

A hand printing stamp having multiple printing surfaces disposed angularly to each other at the bottom portion of a body further including an upper portion adapted to ergonomically fit into the palm of the user when his/her thumb and fingers of the grasping hand are disposed in a generally parallel spaced extending relationship to each other.

7 Claims, 15 Drawing Sheets

ERGONOMICALLY IMPROVED MULTIPLE SURFACE STAMP

BACKGROUND OF THE INVENTION

This invention relates to a hand printing stamp device having adjacent multiple stamp receiving surfaces such that a plurality of text messages or common annotations may be carried on one device, and the user may thus utilize the same device to print a number of messages on the receiving surface without the necessity of multiple stamp devices.

One prior art device that accomplishes some of these objectives is shown by U.S. Pat. No. 2,176,160 to Uhl, Jr. issued Oct. 17, 1939. Such structure shows a base 1 and a manipulating handle 2 of conventional design for such stamps. In manipulating such handle 2, the human user normally grasps the handle in his or her clenched fist with the handle top either resting in the palm of the hand when the fist is clenched downwardly or with the handle sidewalls engaged with the palm of the user's hand when the fist is clenched in an upright position. Either of these positions is satisfactory when the bottom stamp surface is being utilized; however when the alternate stamp surfaces are utilized, it is difficult to bend one's wrist to manipulate the alternate angular stamp receiving surfaces to a downward printing position on the receiving surface especially the rearward bending necessary to properly align the "B" stamp printing surface. The forward downward bending motion of the wrist is called flexion while the rearward upward motion is called extension. Thus, the motion shown in FIG. 2 would be wrist extension. With such devices, it is common to use different grasping techniques to place different printing surfaces in position for printing such as the fist downward grip shown in FIG. 4. Obviously, it would be desirable to be able to use the same grasping position of the device for each of the alternate stamp positions.

It should also be pointed out that these prior art devices of the Uhl, Jr. type are not ergonomically sound and their repeated clenched fist movement could cause overuse injuries such as carpel tunnel syndrome. These prior art devices are also more difficult for older people or those with arthritic hands and younger or handicapped children and adults to use as the grip is awkward and unnatural.

Accordingly, one of the objects of the present invention is to provide a stamping device which can be easily grasped and used by a wide variety of people including young, old and handicapped and which is of an ergonomically sound design so as to reduce the possibility of repeated use injuries.

Accordingly, another of the main objectives of the present invention is to present a device which overcomes these unwieldy grasping motions yet provides a hand printing stamp with alternate adjacent multiple stamp receiving surfaces such that more than one and preferably three print messages may be borne on the same device. This is especially practical for home/business offices, e.g., where documents may be either received or sent and their disposition recorded such as "Filed", "Received", "Paid", "Forwarded", "Faxed" and the like as of a certain date.

These and other objectives of the present invention are accomplished by a hand printing stamp device having adjacent multiple stamp receiving surfaces and a body constructed such that the device may be conveniently grasped by the hand of the user and manipulated to place each of said stamp receiving surfaces in printing contact with a receiving surface without modifying the grasping position of the user comprising a vertically-oriented body having opposed generally parallel upstanding sidewalls, said body including an upper hand graspable portion and a lower stamp receiving portion including a generally flat laterally extending bottom stamp receiving surface having opposed spaced distal and proximal edges, and at least one adjacent stamp receiving surface upwardly outwardly extending from one of said bottom surface edges.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
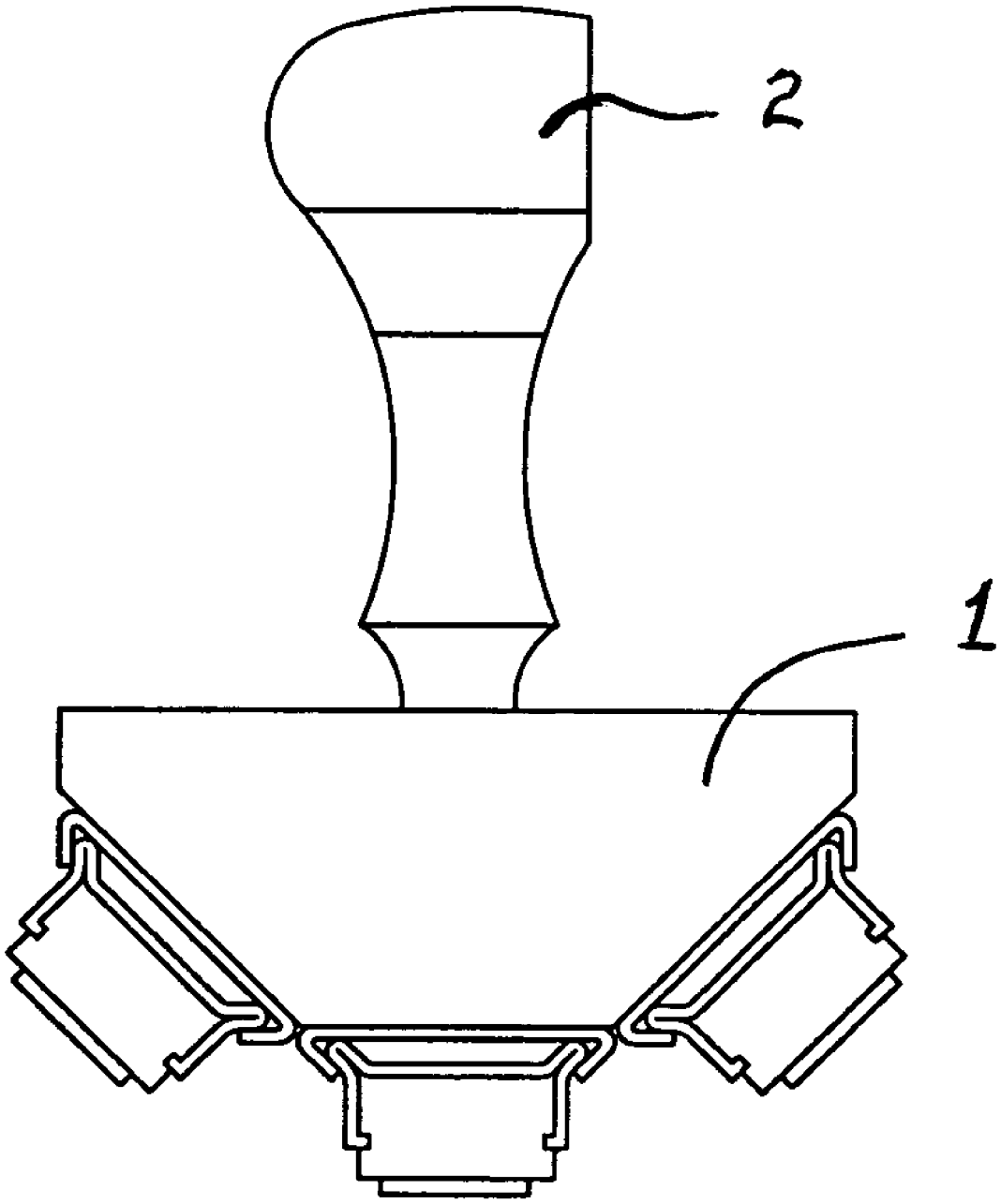
FIG. 1 (PRIOR ART)
FIGS. 1 through 4 depict a prior art device, namely, the patent to Uhl, Jr., in various grasping and stamping modes and show and illustrate the difficulties the user experiences manipulating the alternating stamp printing surfaces during actual use thereof.
Figure 2:
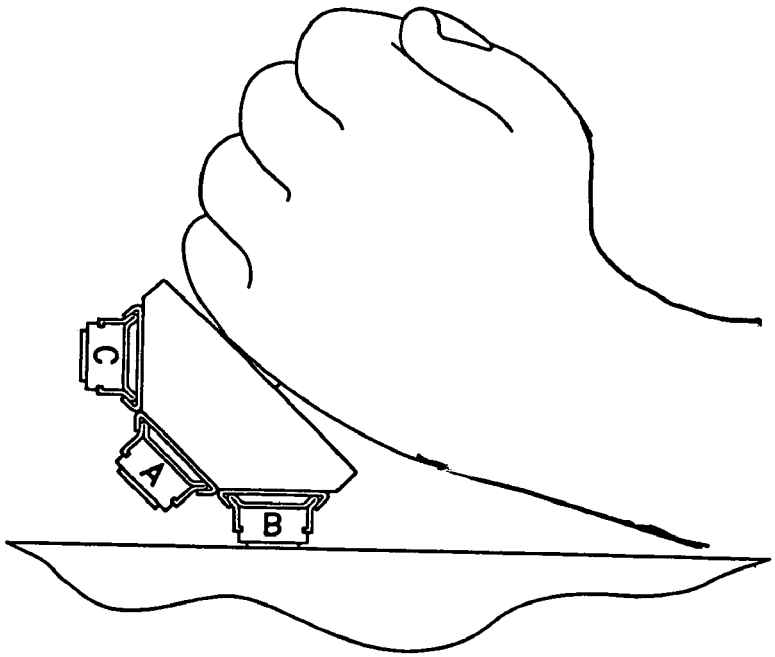
FIG. 2 (PRIOR ART)
Figure 3:
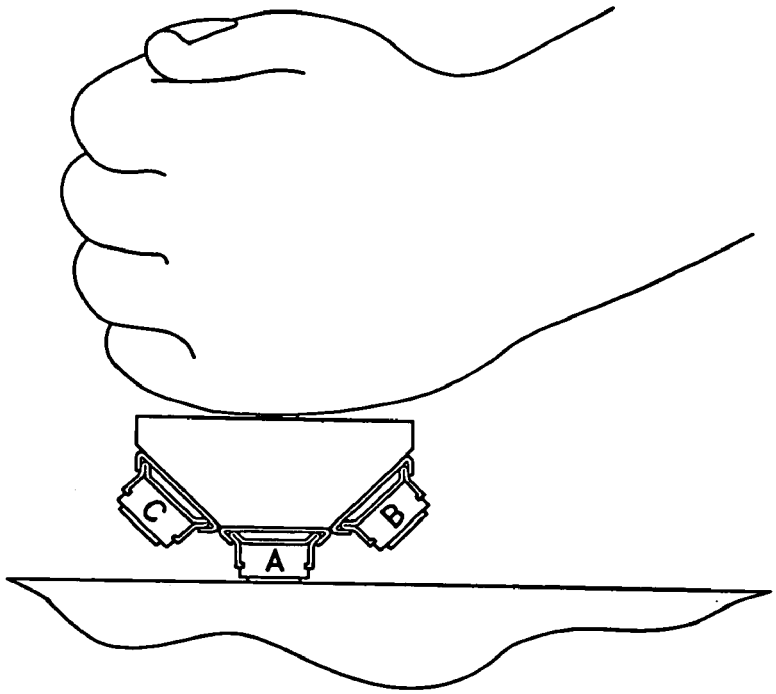
FIG. 3 (PRIOR ART)
Figure 4:
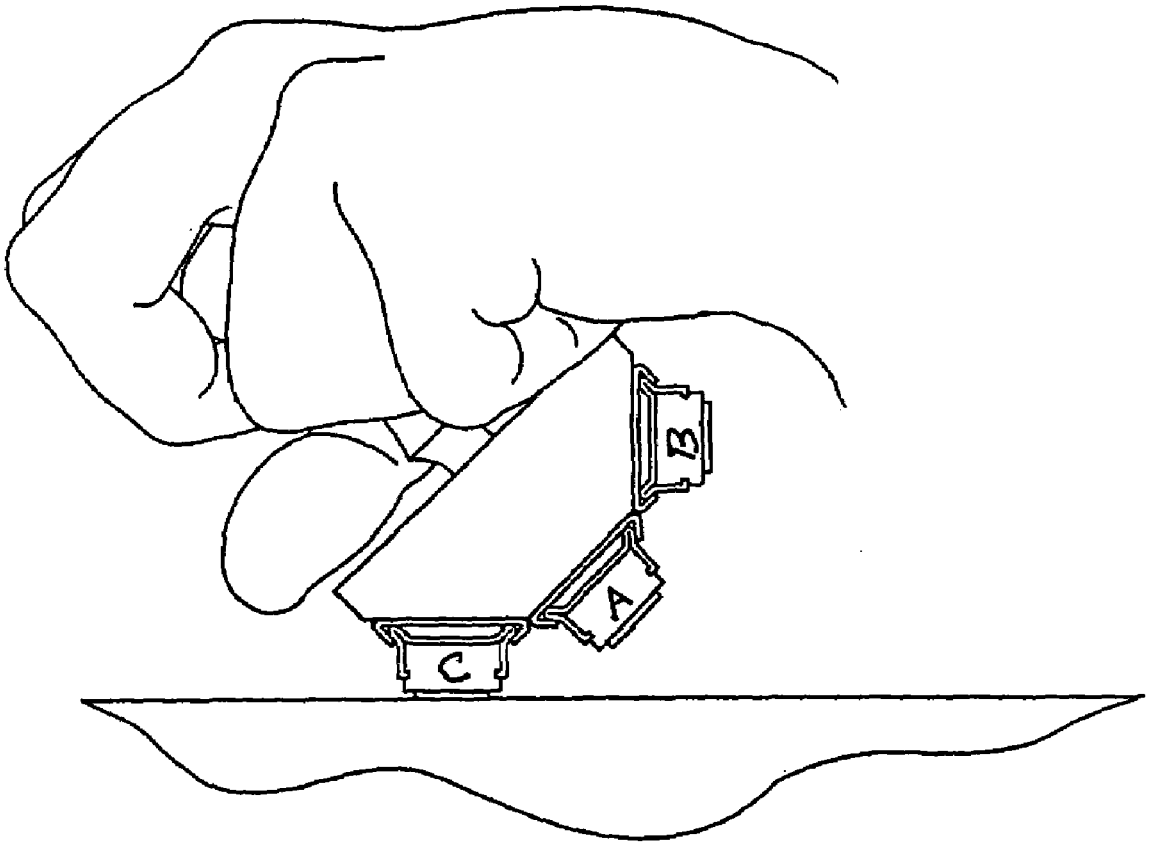
FIG. 4 (PRIOR ART)
Figure 5:
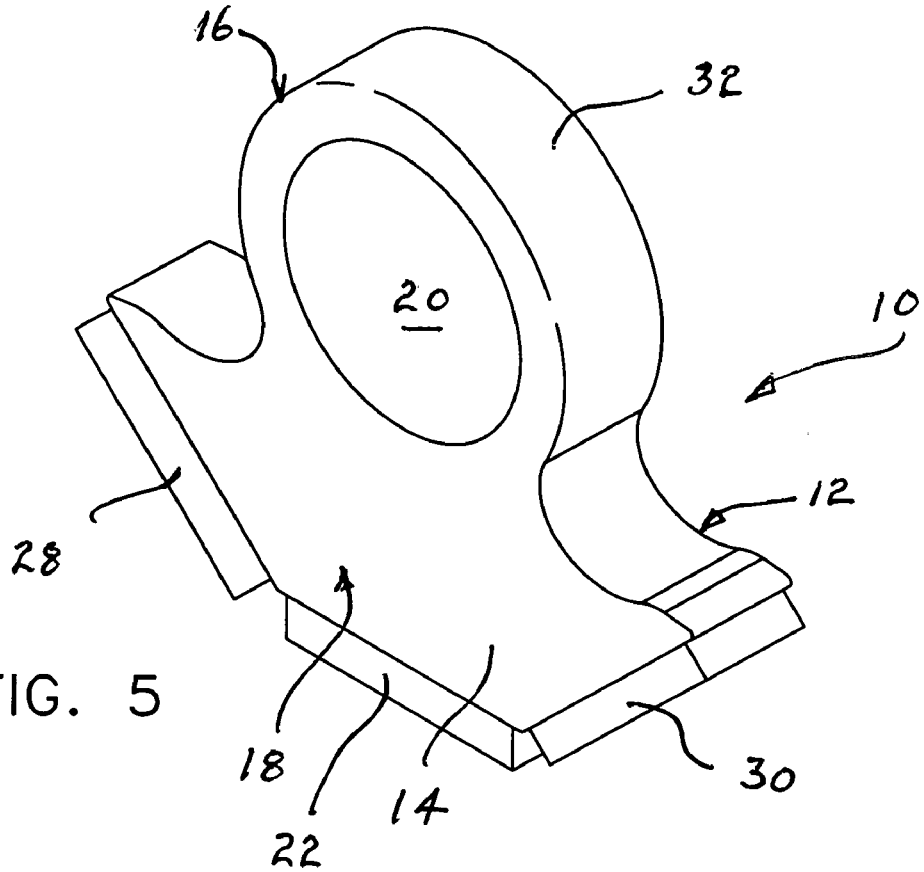
FIG. 5 is a front perspective view of a preferred structure of the device of the present invention.
Figure 6:
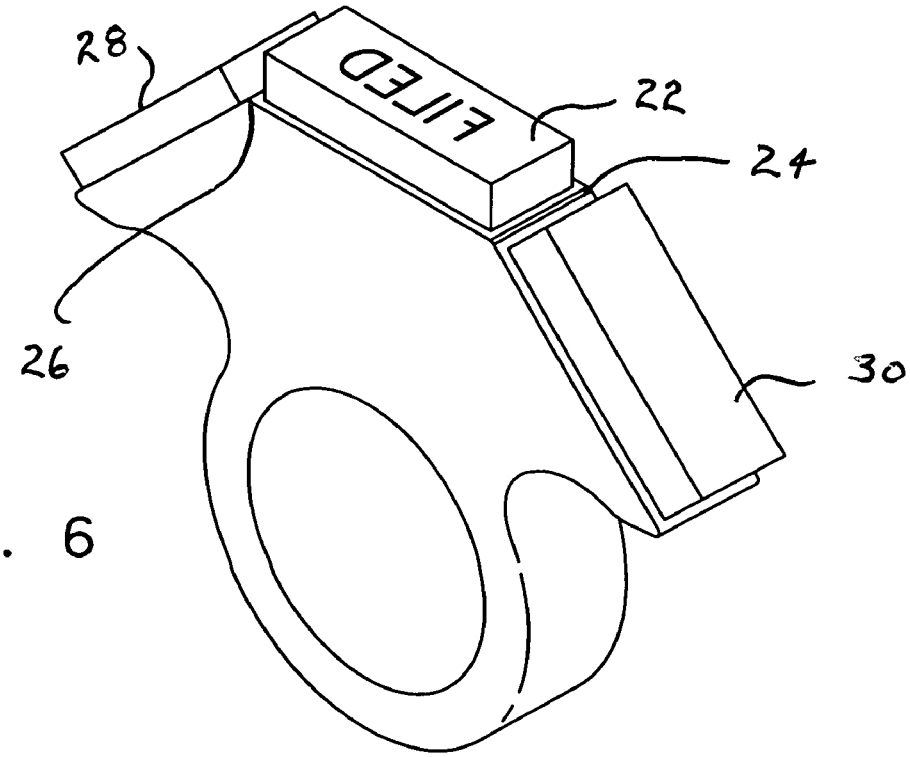
FIG. 6 is a similar to FIG. 5 in an inverted position.
Figure 7:
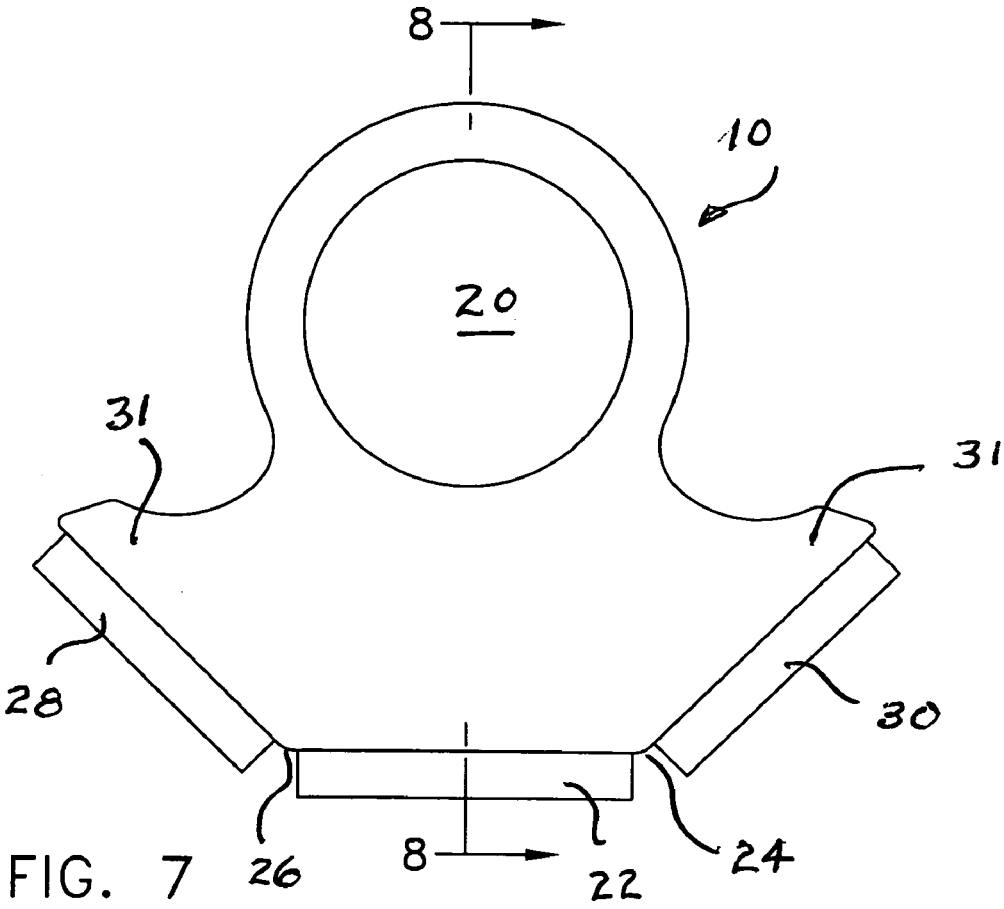
FIG. 7 is a front elevational view thereof.
Figure 8:
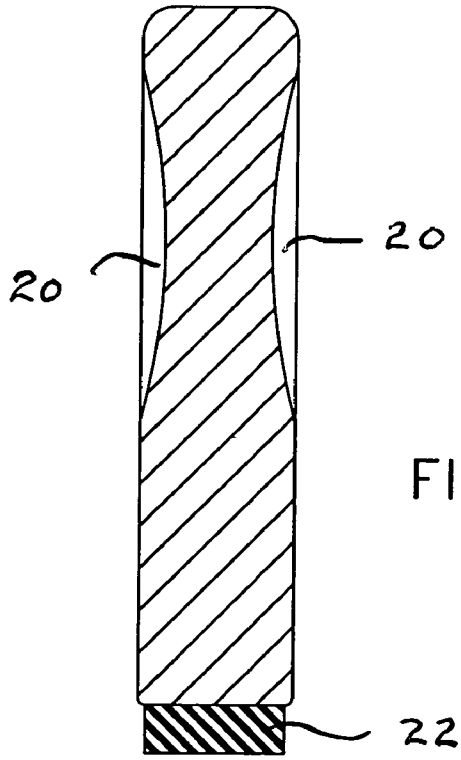
FIG. 8 is a side elevational view thereof taken along the line 8—8 of FIG. 7.
Figure 9:
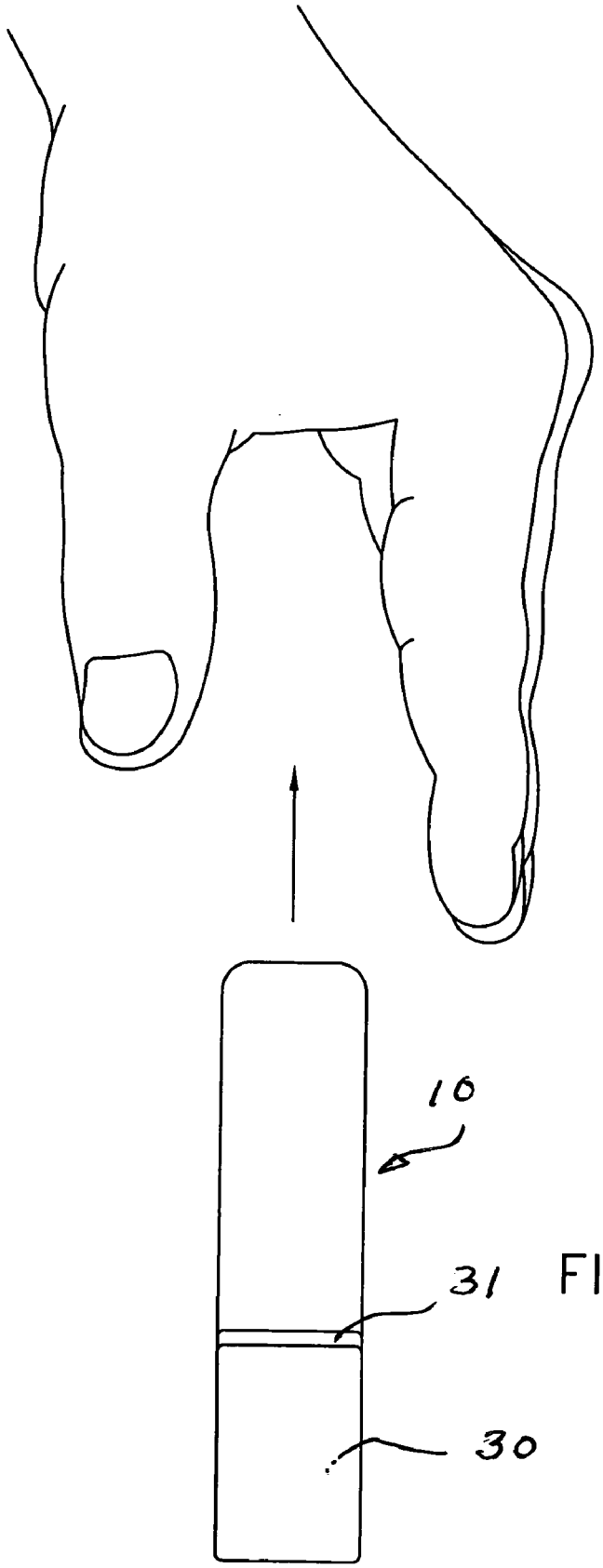
FIG. 9 is a side elevational view showing the preferred manner of grasping the device of the present invention.
Figure 10:
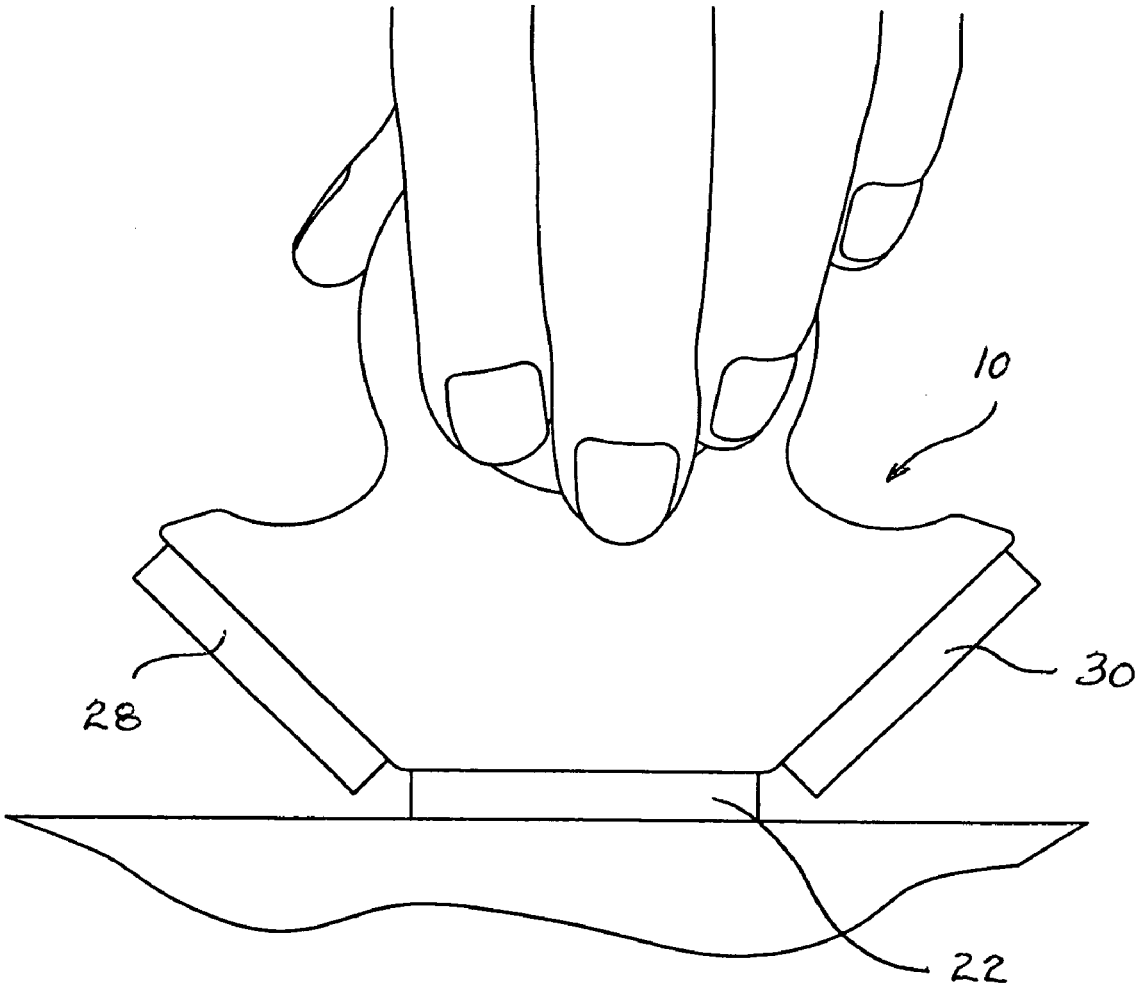
FIGS. 10 through 12 illustrate the alternate manners in which the device of the present invention may be grasped in order to accommodate stamping of the various print surfaces.
Figure 11:
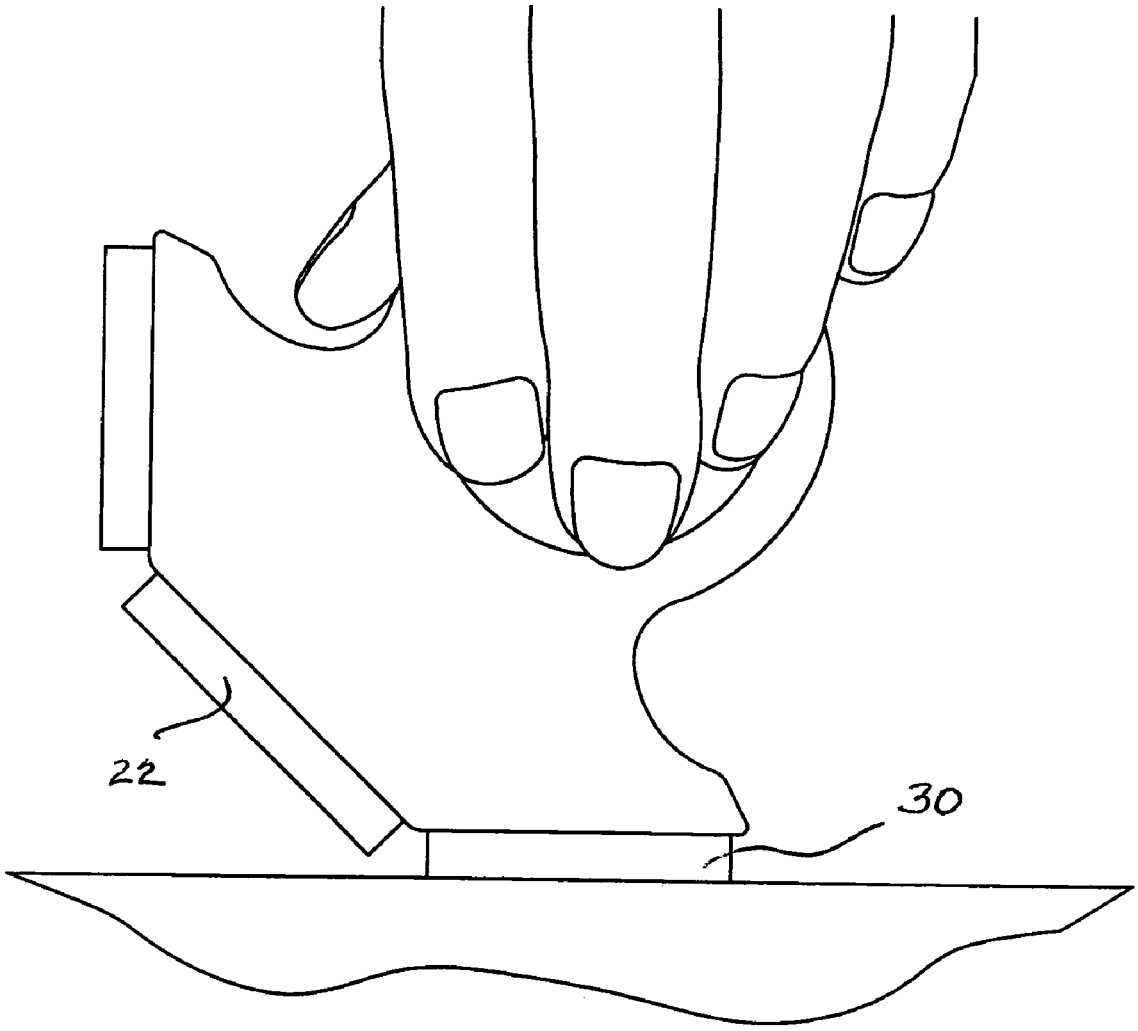
Figure 12:
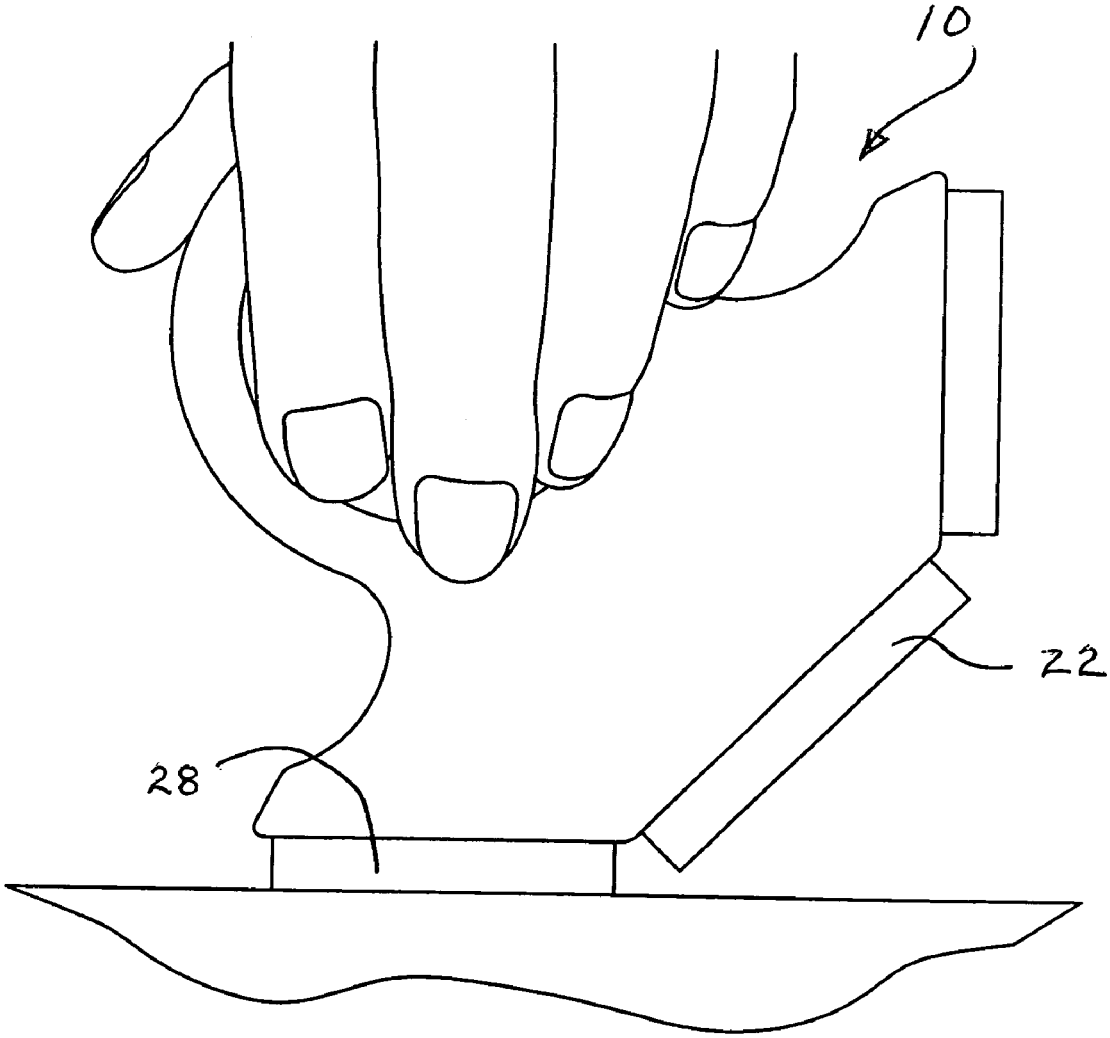

Turning now to the drawings and more particularly to FIG. 5 thereof, the device 10 of the present invention is depicted as having a vertically oriented body 12 with opposed parallel sidewalls 14. The body 12 in turn is divided into two areas, that is, an upper handle or grasping area 16 and a lower stamping portion 18. The sidewalls 16 are preferably although not necessarily each provided with a generally circular recess area 20 to facilitate the grasping of the handle portion 16. The handle preferably is of an overall circular configuration to better fit into the user's palm area in one of the (and preferred) manners of use of the device.

Figure 13:
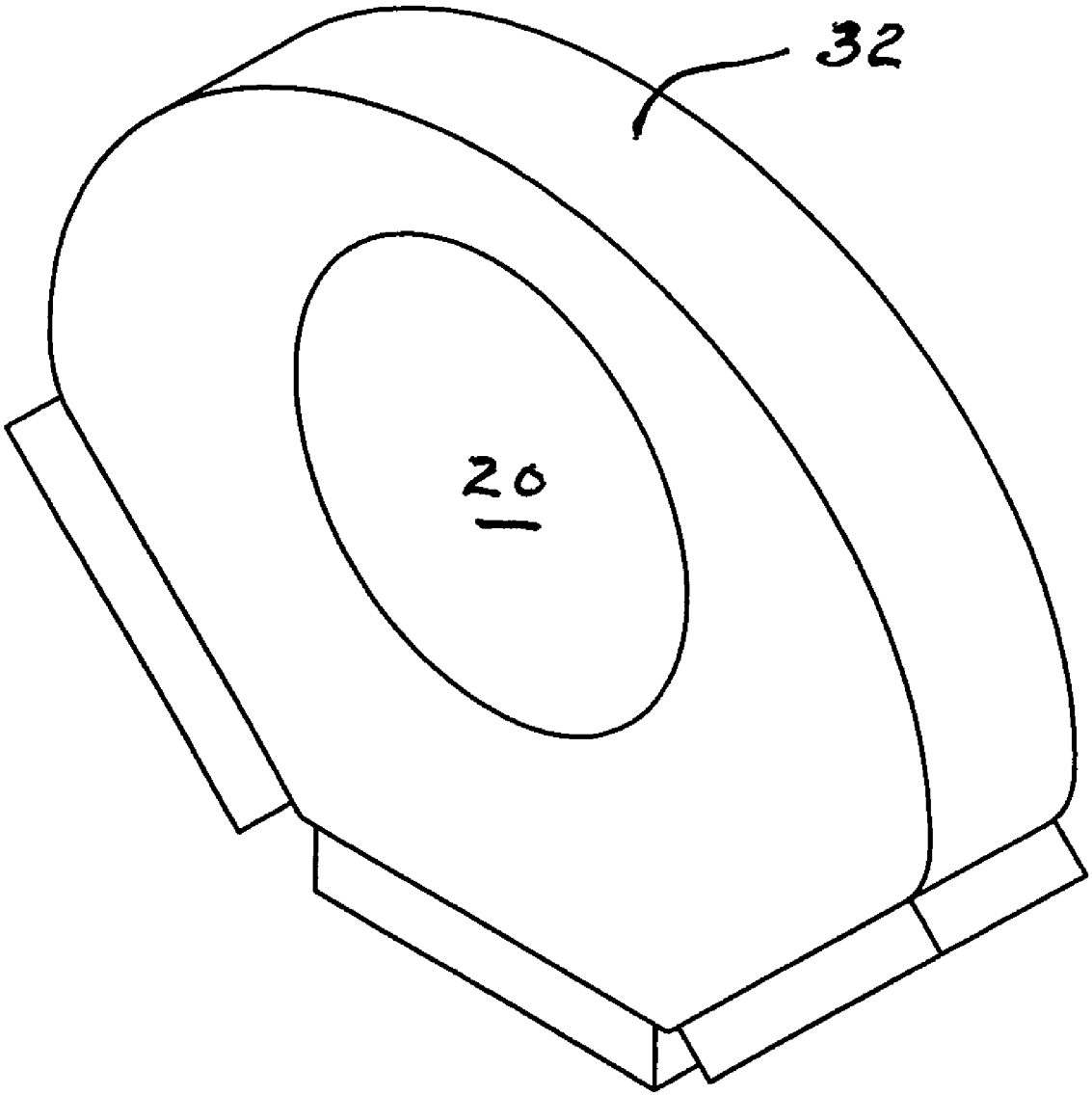
FIG. 13 shows an alternate shape of the device.

The stamp-receiving portion 18 includes a lower generally flat primary stamp receiving surface 22 which laterally extends and terminates in spaced proximal and distal edges 24 and 26 respectively. At least one and preferably two secondary stamp receiving surfaces are present. One such surface 28 upwardly outwardly extends from the distal edge 26 while the other such surface 30 upwardly outwardly laterally extends from the proximal edge 24 and thus may form a pair of outwardly extending wings 31 as part of the body of the device. Alternate forms of the handle area 16 wherein such winged configuration is less prominent may be utilized, e.g., this area may be scallop-shaped (see FIG. 13).

The upper handle portion 16 rounded at its top surface 32 is further defined by the pair of downwardly extending parallel sides 14 where the arcuate configuration of the upper surface 32 enhances the manner in which the device may be snuggly engaged in the palm of the user's hand while the thumb rests on one sidewall and the fingers are disposed on the opposite sidewall. To accommodate such positioning, the height of the handle area may be approximately 2–3 inches such that the thumb and fingers may be disposed in a downward pointing spaced generally parallel relation for grasping the sides 14 while the top surface 32 contacts and in turn rests in the user's palm. Smaller versions of the device for children or more adapted for opposed thumb and finger grasping without palm supporting contact with the upper surface 32 can also be provided. In this preferential position of grasping the handle, e.g. with the right hand, the user can simply slightly rotate his/her wrist either right of left (pronation or supination) such that the distal stamping surface is positioned in a parallel mode to the receiving surface and rotated slightly either right or left (supination or pronation) so as to place the proximal stamping surface in the same stamping position. Thus, it should be apparent that this grasping position avoids the normally clenched fist position of the prior art and enables rapid and easy stamp manipulation in a quick and simple manner.

Figure 14:
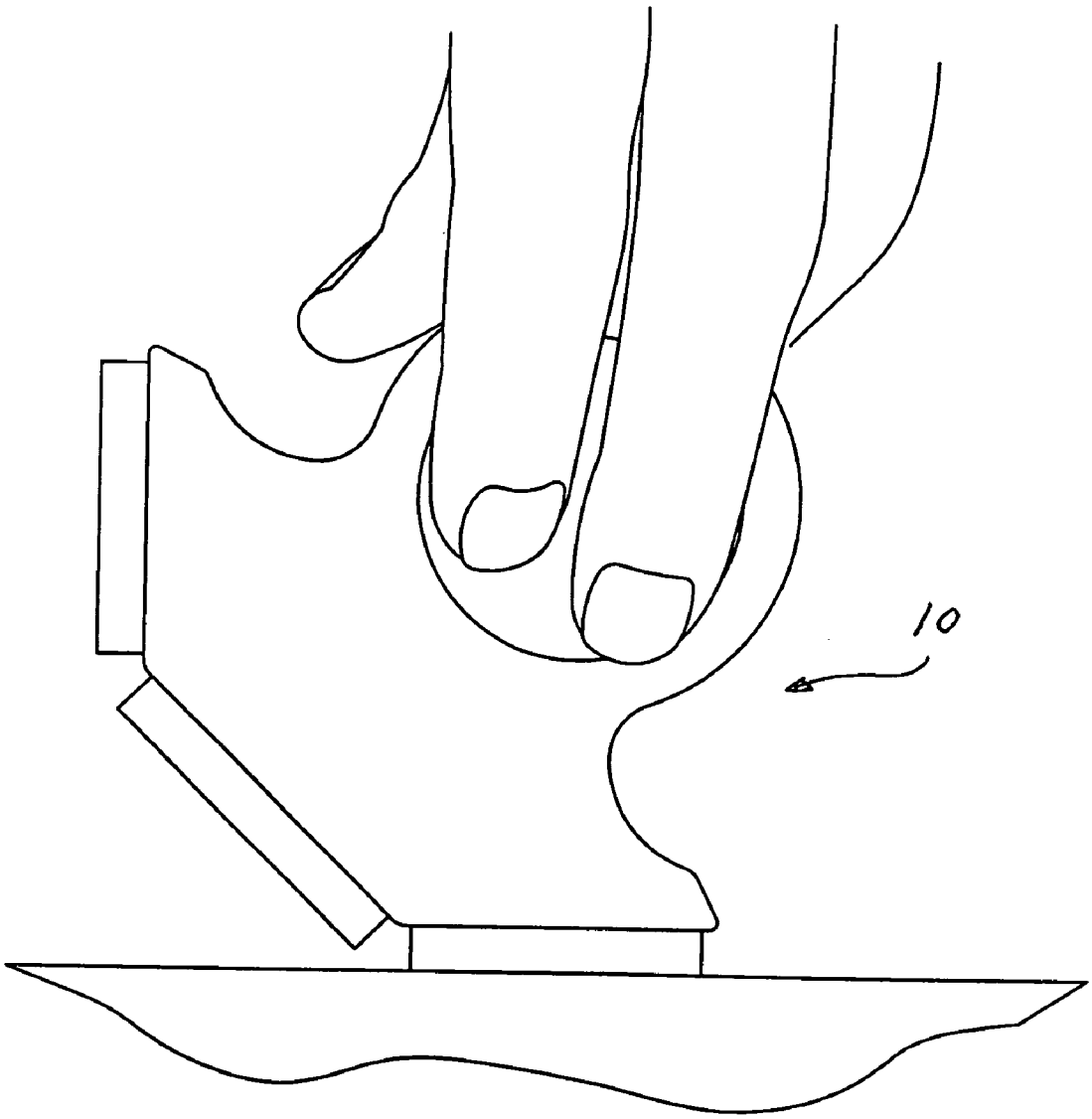
FIGS. 14 through 16 show alternate gripping styles.
Figure 15:
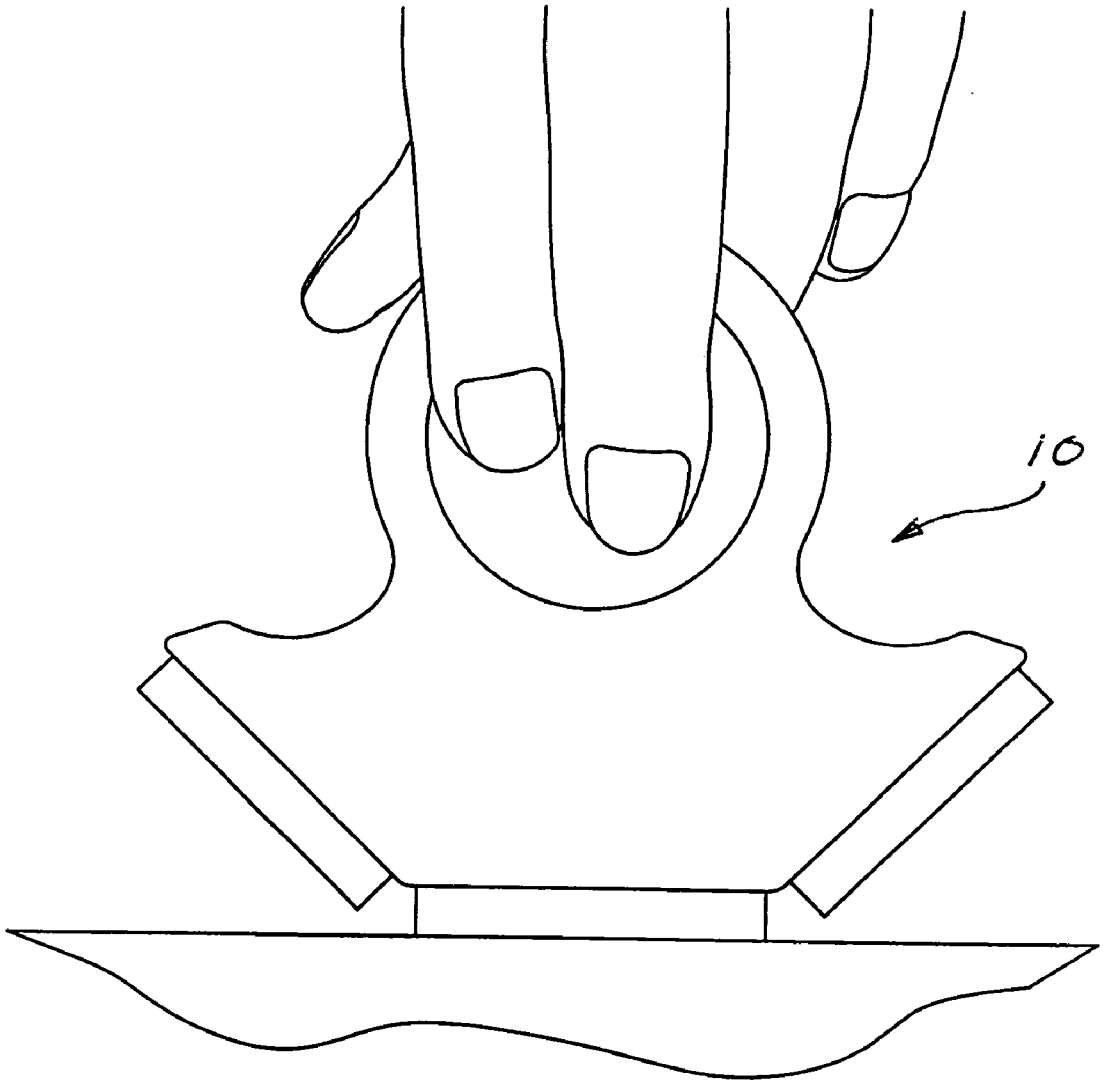
Figure 16:
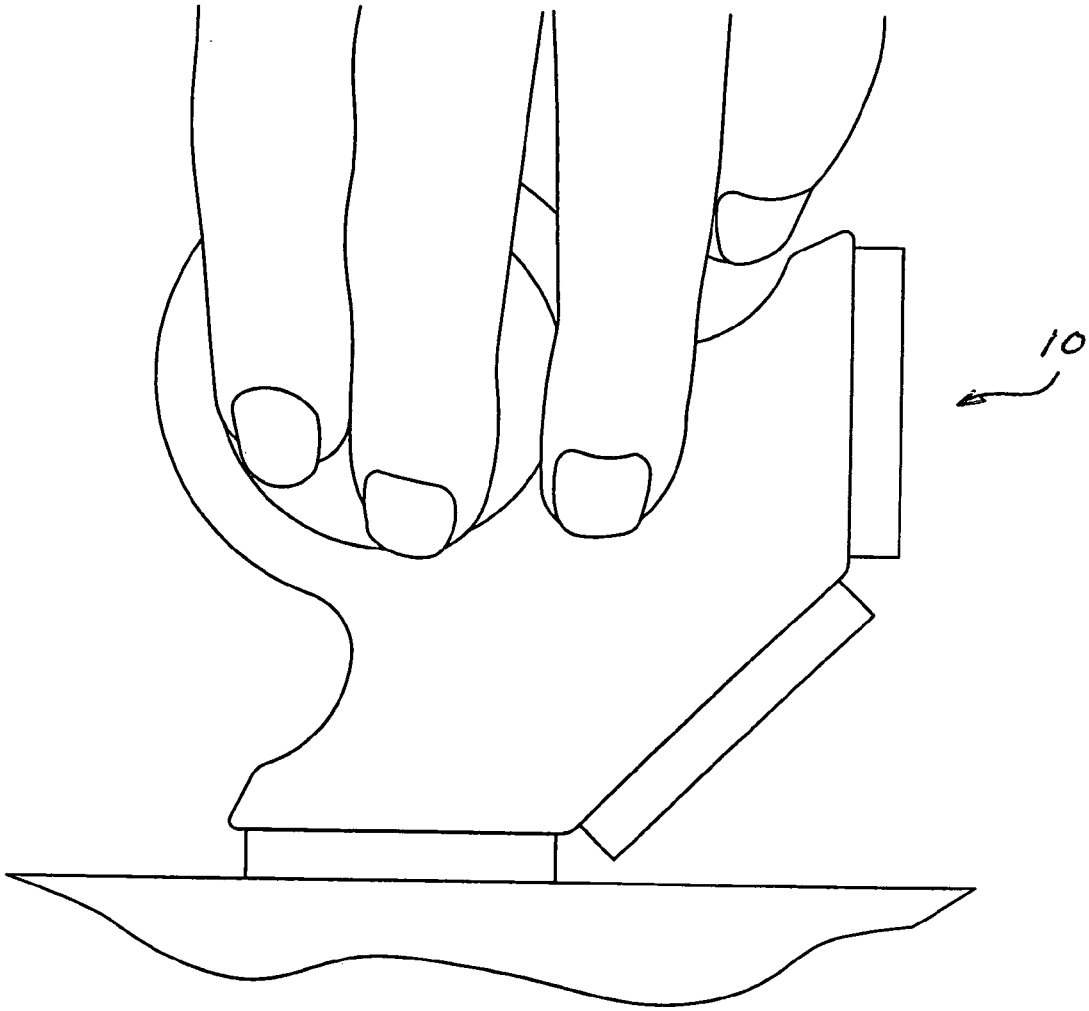

This preferred grasping position is illustrated in FIGS. 9–12 where the surface 22 is in printing position and from which position the alternate surfaces 28 and 30 can be placed in printing position simply by a slight rotational movement of the wrist while the comfortable grasp is maintained. Sometimes, the user simply does not want to be so efficient or has need for imprinting only one message of the alternate messages available on the surfaces 22, 28 and 30 and thus can utilize alternate grip attitudes for each printing message as shown in FIGS. 14–16, and it should be pointed out that the structure of the handle with its upright orientation and opposed essentially flat side surfaces of the present device accommodates grasping at such different angular attitudes. In addition as is apparent in FIGS. 10–16, the weight balance of the device is such that it is free standing on any of the three stamping attitudes, that is, it stands upright on any of the three printing surfaces.

Figure 17:
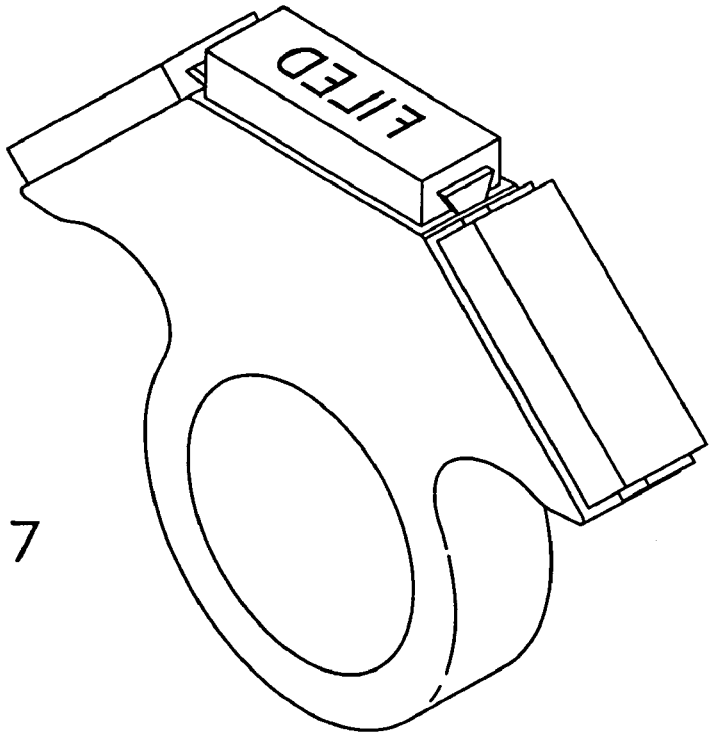
FIGS. 17 and 18 show one manner in which the stamp portion of the device may be attached thereto.
Figure 18:
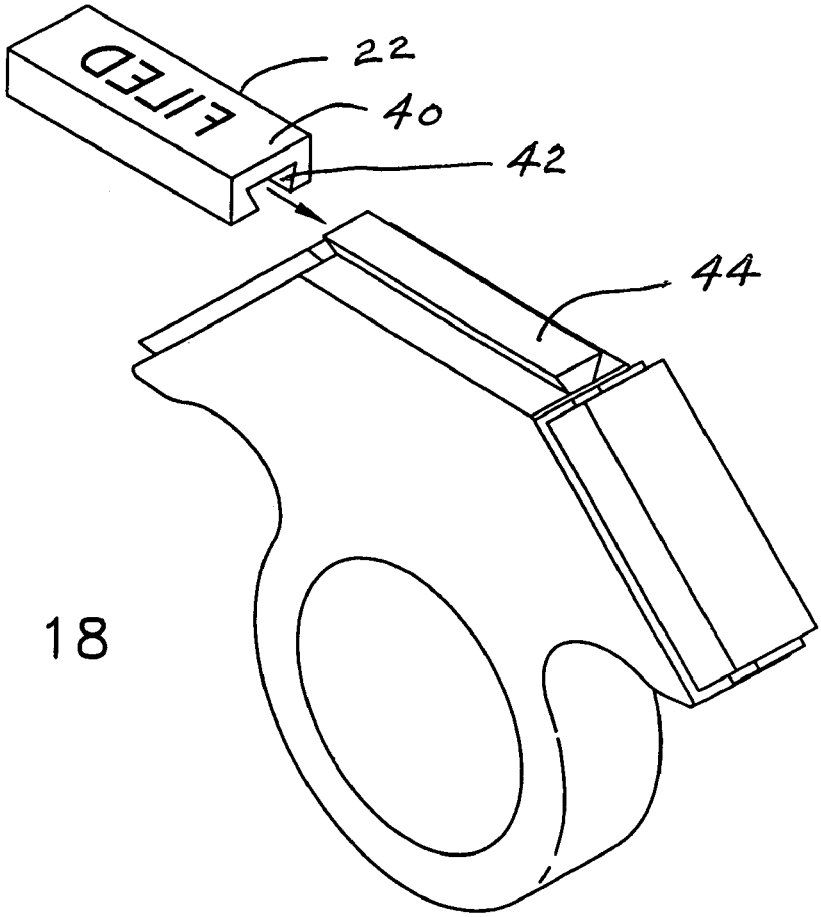

The lower 22 and alternate stamp receiving surfaces 28, 30 are provided with some means by which the actual printing surface bearing the desired indicia is mounted. Such may include the channel system as shown by the previously discussed patent Uhl, Jr. which is hereby incorporated in the present specification by specific reference thereto or by other means such as a longitudinally extending undercut recess 42 or boss on each of such stamp receiving surfaces such that the stamp indicia can be incorporated on a separate element or block having a cooperatively shaped boss 44 or recess. Such attachment is shown in FIGS. 17 and 18. The block is then slid into the recess or undercut and may be, accordingly, removed to change the indicia or when worn. Alternatively, the indicia could be simply molded into the stamp receiving surfaces; and when worn, the entire device discarded and replaced with a new stamping device. Also, the stamping surface block 40 could simply be adhesively attached to the receiving surfaces 22, 28 and 30. The stamping block or stamp-receiving surface could be in the form of a cartridge, e.g., replaceable that includes its own ink supply.

Figure 19:
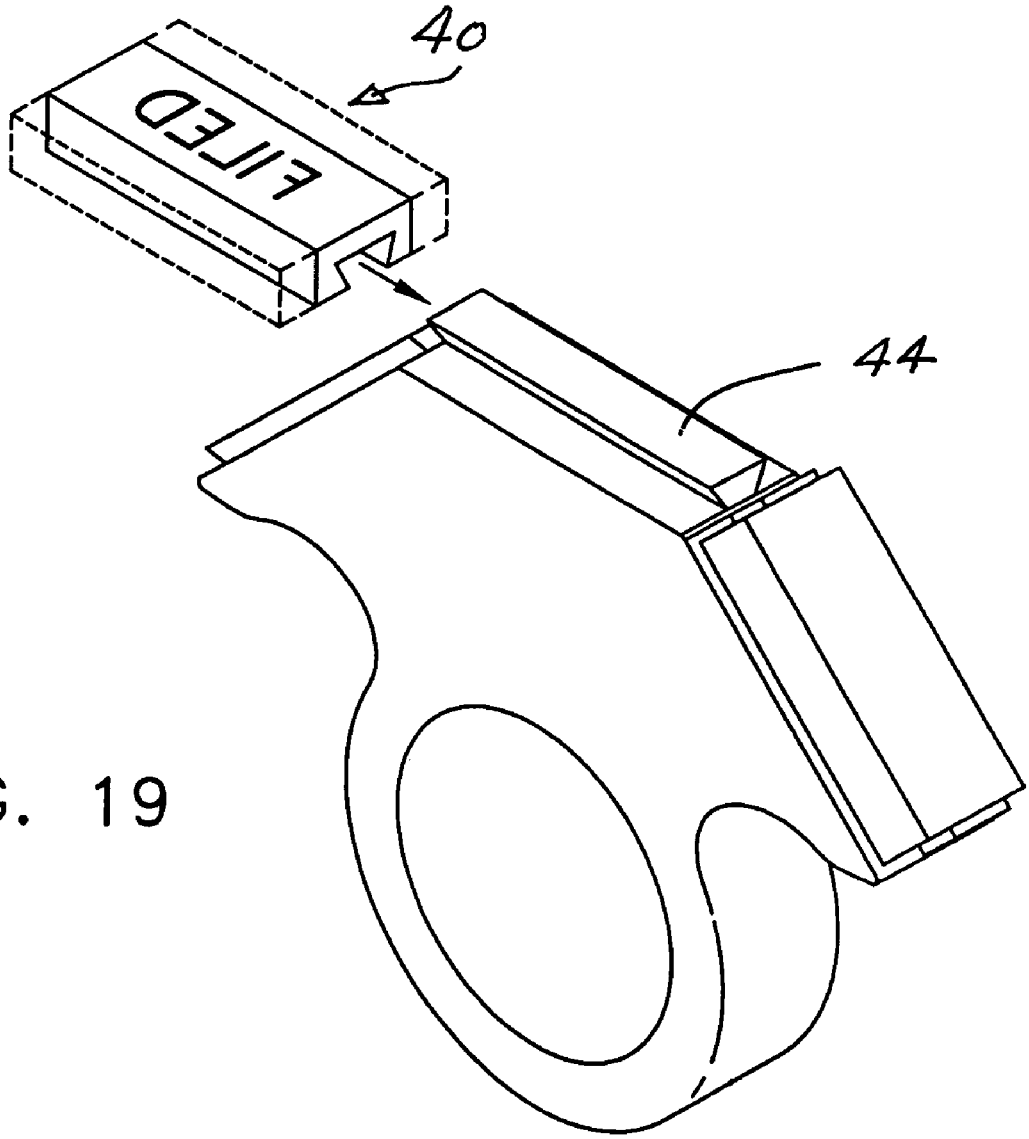
FIG. 19 shows a variation stamp structure which is wider than the width of the body portion of the device to accommodate space for larger type and/or messages.

Generally, the device is constructed in one piece from molded plastic resin, but alternatively could be carved in wood. Also as shown in FIG. 19, the stamp-receiving surface may be wider than the width of the body of the device so as to accommodate more message space and/or larger type.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A hand printing stamp device having adjacent multiple stamp receiving surfaces and a body constructed such that the device may be conveniently grasped by the hand of the user and manipulated to place each of said stamp receiving surfaces in printing contact with a receiving surface without modifying the grasping position of the user comprising, a vertically-oriented body having opposed generally parallel upstanding and laterally extending sidewalls, said body including an upper hand graspable portion and a lower stamp receiving portion including a generally flat laterally extending bottom stamp receiving surface having opposed spaced distal and proximal edges, and at least one adjacent stamp receiving surface upwardly outwardly extending from one of said bottom surface edges, said hand graspable portion being an upstanding boss portion with parallel opposed sides in turn parallel to and generally forming continuing wall portions with said parallel upstanding sidewalls and wherein the opposed sides of said graspable portion and said stamp receiving portion are both laterally aligned and parallel with each other and of generally equal thickness, said boss portion having a smooth rounded upper surface laterally extending the entire lateral extent of said graspable portion such that the palm of the user of the device may contact said graspable portion upper surface and the user's opposed thumb and fingers contact the opposed continuing wall portions formed by said boss sides and said walls of said stamp receiving surface.

2. The device of claim 1, wherein a pair of adjacent stamp receiving surfaces upwardly outwardly extend from each of said bottom surface edges.

3. The device of claim 2, said adjacent stamp receiving surfaces forming a pair of opposed wings laterally extending from the lower portion of said body.

4. The device of claim 1, said body upper hand graspable portion including laterally opposed generally circular inwardly extending recesses formed in said parallel sidewalls.

5. The device of claim 3, said device being self-supportive in an upright position on each of the multiple stamp receiving surfaces.

6. The device of claim 2, wherein each of said stamp receiving surfaces is in the form of a cartridge including printing indicia and an ink supply.

7. The device of claim 5, wherein at least one of said stamp receiving surfaces of a width substantially greater than that of said device body.

* * * * *